US010738946B2

(12) United States Patent
Wu et al.

(10) Patent No.: US 10,738,946 B2
(45) Date of Patent: Aug. 11, 2020

(54) LED LIGHT BULB

(71) Applicant: XIAMEN ECO LIGHTING CO., LTD., Xiamen (CN)

(72) Inventors: Chenjun Wu, Xiamen (CN); Hongkui Jiang, Xiamen (CN); Yanzeng Gao, Xiamen (CN); Yongchuan Li, Smyrna, GA (US)

(73) Assignee: XIAMEN ECO LIGHTING CO., LTD., Xiamen (CN)

( * ) Notice: Subject to any disclaimer, the term of this patent is extended or adjusted under 35 U.S.C. 154(b) by 0 days.

(21) Appl. No.: 16/653,983

(22) Filed: Oct. 15, 2019

(65) Prior Publication Data

US 2020/0049315 A1 Feb. 13, 2020

Related U.S. Application Data

(63) Continuation-in-part of application No. 16/410,679, filed on May 13, 2019, which is a continuation of application No. 15/905,399, filed on Feb. 26, 2018, now Pat. No. 10,330,263.

(60) Provisional application No. 62/756,600, filed on Nov. 7, 2018, provisional application No. 62/463,708, filed on Feb. 26, 2017, provisional application No. 62/463,711, filed on Feb. 26, 2017, provisional application No. 62/463,713, filed on Feb. 26, 2017, provisional application No. 62/463,715, filed on Feb. 26, 2017.

(51) Int. Cl.

| | |
|---|---|
| ***F21K 9/232*** | (2016.01) |
| ***F21K 9/238*** | (2016.01) |
| ***H05B 45/00*** | (2020.01) |
| *F21Y 107/00* | (2016.01) |
| *F21V 3/02* | (2006.01) |
| *F21Y 115/10* | (2016.01) |

(52) U.S. Cl.

CPC ..... *F21K 9/232* (2016.08); *F21K 9/238* (2016.08); *H05B 45/00* (2020.01); *F21V 3/02* (2013.01); *F21Y 2107/00* (2016.08); *F21Y 2115/10* (2016.08)

(58) Field of Classification Search

CPC ..... F21K 9/232
USPC ..... 362/249.02
See application file for complete search history.

(56) References Cited

U.S. PATENT DOCUMENTS

2009/0184618 A1* 7/2009 Hakata ..... H01L 25/0753 313/1
2010/0207502 A1* 8/2010 Cao ..... F21V 3/00 313/46
2010/0253221 A1* 10/2010 Chiang ..... F21K 9/00 315/32

(Continued)

*Primary Examiner* — Christopher M Raabe
(74) *Attorney, Agent, or Firm* — Chun-Ming Shih; LanWay IPR Services

(57) ABSTRACT

A light bulb apparatus includes a head cup, a bottom support, multiple light strips and a bulb shell. The head cup is connected to an external power source. The bottom support is extended from the head cup. Each light strip has a top end and a bottom end. The bottom ends of the light strips are connected to the bottom support. The top ends of the light strips form a top polygonal shape and the bottom ends of the light strips form a bottom polygonal shape. The bottom polygonal shape has a bigger area size than the top polygonal shape. Each light strip has a skewed angle with respect to a middle axis perpendicular to the bottom shape.

20 Claims, 23 Drawing Sheets

(56) References Cited

U.S. PATENT DOCUMENTS

| | | | | |
|---|---|---|---|---|
| 2013/0058080 | A1* | 3/2013 | Ge | F21V 19/005 362/231 |
| 2013/0235592 | A1* | 9/2013 | Takeuchi | F21V 19/003 362/363 |
| 2014/0197440 | A1* | 7/2014 | Ye | F21V 3/02 257/98 |
| 2014/0268779 | A1* | 9/2014 | Sorensen | F21K 9/232 362/249.06 |
| 2015/0070871 | A1* | 3/2015 | Chen | F21K 9/27 362/84 |
| 2016/0363267 | A1* | 12/2016 | Jiang | F21V 29/70 |
| 2017/0012177 | A1* | 1/2017 | Trottier | H01L 25/0753 |
| 2017/0016580 | A1* | 1/2017 | Chung | H01L 33/62 |
| 2017/0038010 | A1* | 2/2017 | Rao | F21V 23/001 |
| 2017/0241598 | A1* | 8/2017 | Jiang | H01L 24/48 |
| 2019/0032857 | A1* | 1/2019 | Cao | F21K 9/232 |
| 2019/0032858 | A1* | 1/2019 | Cao | F21K 9/238 |
| 2019/0093831 | A1* | 3/2019 | Jiang | F21K 9/237 |
| 2019/0195432 | A1* | 6/2019 | Cao | F21V 23/003 |

* cited by examiner

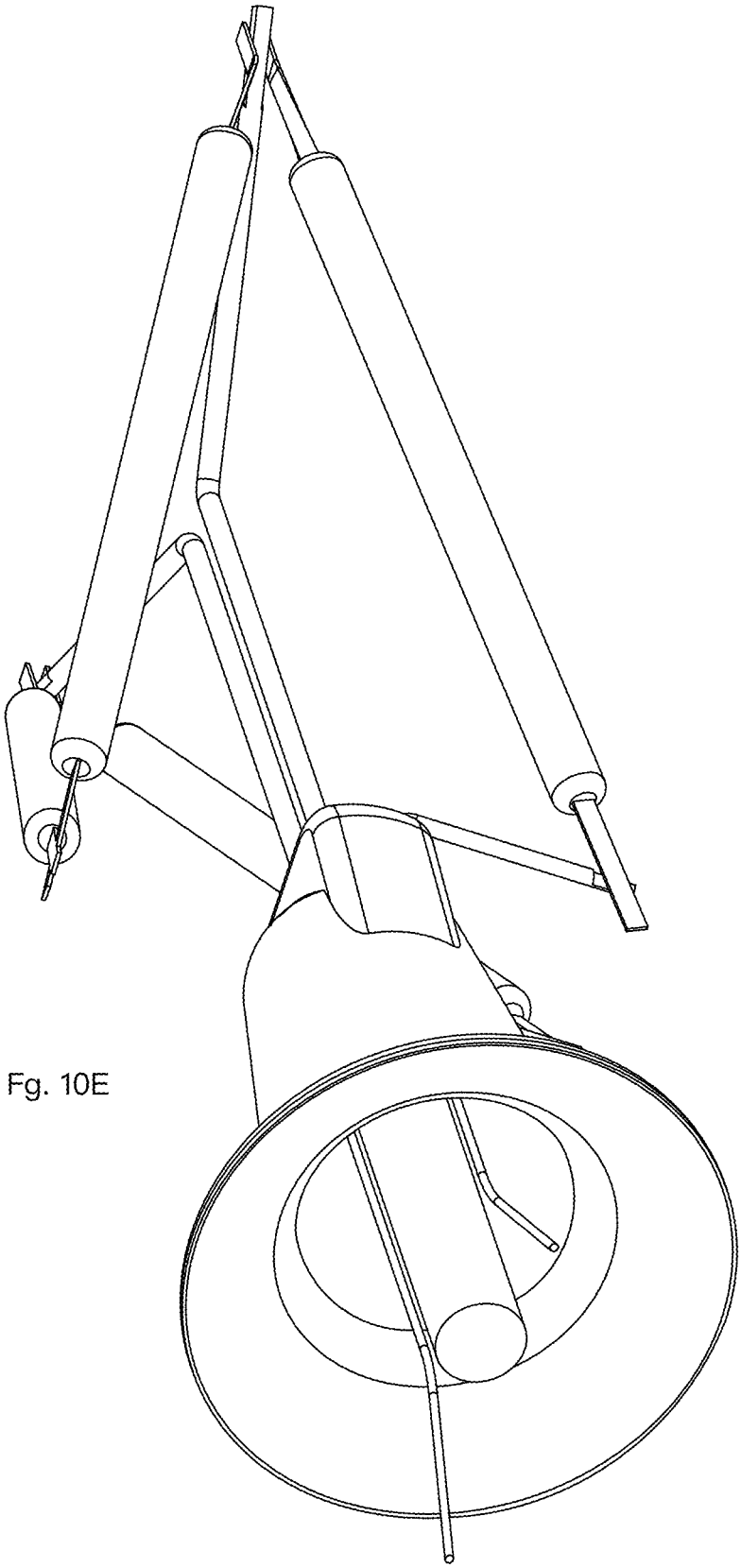
Fg. 10E

LED LIGHT BULB

RELATED APPLICATION

The present application is a continuation-in-part application of U.S. Filing Ser. No. 16/410,679, which is a continued-application of U.S. Filing Ser. No. 15/905,399.

FILED OF THE INVENTION

The present invention is related to a light bulb apparatus and more particularly related to a light bulb apparatus with light strips.

BACKGROUND

There are various light devices in the world. After Edison invented light bulbs, related technologies are still developing, particularly after the LED (Light Emitted Diode) devices are introduced to the world.

LED has many advantages compared with past technology. There is a trend to replace traditional light devices with LED light devices, because LED light devices have better luminous efficacy while converting electricity.

In some applications, luminance level is not the only factor to concern. For examples, filament light bulbs are welcome because they have nice looking and cause people to remember their best memory. There are lots of filament light bulbs in various places, particularly for decoration purposes.

When trying to apply LED technology on filament light bulbs, there are many difficult problems to solve, including but not limited to heat dissipation, appearance, robustness, etc.

Therefore, it is very beneficial to develop a cost effective solution for finding ways to apply LED technology in filament bulb applications.

SUMMARY OF INVENTION

According to an embodiment of the present invention, a light bulb apparatus has a head cup, a bottom support, multiple light strips and a bulb shell.

The head cup is designed to be connected to an external power source, e.g. complying with various Edison bulb cap standards. The head cup also has a containing space for storing a driver circuit for converting external power source to proper driving current to drive the LED components of the light apparatus.

The bottom support is connected and extended from the head cup. Parts of the bottom support are made of glass material. To provide better heat dissipation, heat dissipation air may be introduced into the bulb apparatus. In such case, the glass part of the bottom support may have a through hole to letting heat dissipation air into the bulb apparatus and then sealed during manufacturing.

The bottom support may be integrated with the bulb shell when they are both made of glass material. In addition to the glass part, there may be other material to form other parts of the bottom support.

The multiple light strips are mounted with LED modules. The LED modules may have different color temperatures and mixed to form a desired color temperature. In addition, the driver circuit may be configured to change luminous level of the LED modules, e.g. changing driving currents supplied to the LED modules.

In some embodiments, the LED modules have different types of LED modules with different color temperatures. The driver circuit may be configured to provide different driving current to different types of the LED modules so that when the LED are turned brighter, the mixed color temperature is more like a day light and when the LED are turned less brighter, the mixed color temperature is more like color temperature during sunset.

Each light strip has a top end and a bottom end. The bottom ends of the light strips are connected to the bottom support for being electrically connected to the driver circuit. In other words, the driver circuit provides driving current to the light strips via components of the bottom support, e.g. some metal bars or strips.

The top ends of the light strips form a top polygonal shape, and the bottom ends of the light strips form a bottom polygonal shape. The bottom polygonal shape has a bigger area size than the top polygonal shape. Since each light strip has a top end and a bottom end, the top polygonal shape may be geometrically similar, in some case, to the bottom polygonal shape. For example, the top polygonal shape and the bottom polygonal shape are both hexagonal shapes, just with different area sizes.

Each light strip has a skewed angle with respect to a middle axis perpendicular to the bottom polygonal shape. The middle axis is a virtual axis perpendicular to the bottom polygonal shape and extends from the middle of the bottom polygonal shape. The light strips surround the middle axis and are skewed with a skewed angle so that their projection are still not parallel to the middle axis.

The bulb shell is extended from the head cup covering the bottom support and the plurality of light strips.

In some embodiments, the bulb apparatus may further have a central support. The central support has a bottom part connected to the bottom support and having a top part connected to the top ends of the plurality of the light strips.

In some embodiments, the central support is a vertical bar that has its bottom part connected to the bottom support and its top part connecting to the top ends of the multiple light strips.

In some embodiments, the vertical bar has a metal top portion and an insulation middle portion. The insulation middle portion may be made of transparent plastic material or glass material to have a better appearance.

In some embodiments, the vertical bar has a metal part embedded in a glass portion of the bottom support. This may be implemented by placing the metal part in a molding device and then covered with fluid heated glass. After the glass is cooled, the metal part is sealed in the bottom support.

In some embodiments, the vertical bar is a tube. Such method reduces material usage and saves cost while keeping rigidity of the vertical bar.

In some embodiments, the vertical bar is an elongated folded metal sheet. In other words, an elongated sheet is folded to increase its rigidity.

In some embodiments, the vertical bar is metal material and has one more fins to help heat dissipation.

In some embodiments, the light bulb apparatus may further include a bracket for connecting the top ends of the light trips to the vertical bar.

The bracket may have multiple metal bars, or in other way, e.g. a circle shape with a bar connected to the vertical bar.

In some cases, the bracket has multiple metal bars and parts of the metal bars are welded to the vertical bar.

In some embodiments, the bracket may have multiple metal bars, parts of the metal bars are embedded to a glass portion of the vertical bar. Like what being explained above, when the vertical bar is made of glass material, parts of the bracket may be placed in a molding device and filled with fluid heated glass material. When the glass material is cooled down, the bracket is fixed to the vertical bar.

In some embodiments, the top end of the light strip has a metal portion extended from a substrate of the light strip. In such case, the light strip is made of a substrate mounted with LED modules that are further covered by fluorescent material. The substrate has a metal part and the metal part is extended to the top end of the light strip. In other words, the top end and the substrate of the light strip is one piece, which may be cut from a metal sheet.

The top ends of the light strips may be folded to keep the light strip with a distance from the vertical bar.

In some cases, two light strips are made together and form a pair. In such pair, the two light strips share the same metal material and thus their top ends are two portion of a one piece material. In such case, the connection between the two light strips has better electricity conductivity and may decrease unnecessary heat due to resistance of the connected portion between the two light strips.

Therefore, in a light bulb apparatus of such case, if there are six light strips, there are three pairs of light strips placed in the bulb apparatus, instead of fixing six independent light strips together, which may also decrease manufacturing time and difficulty.

In some embodiments, a connection part of the top ends of the two light strips surrounds the vertical bar. For example, the top ends of two light strips are welded together while leaving a hole in the middle of the connection. The vertical bar is placed in the middle of the connection, thus increasing robustness of overall light bulb structure.

In some embodiments, the top ends of the light strips are separately connected to a bracket and the bracket enables electrical connection between the two ends of the light strips. For example, the bracket may have multiple metal bars as mentioned above. The top ends of the light strips are separately welded to the metal bars. With the metal bar as an intermediate component, the light strips may be connected in desired connection manner, e.g. connected in series or in parallel.

Usually, the light strips have a major light emitting angle, e.g. 120 degrees. The central direction of the light emitting span is named as the major light direction.

In some embodiments, the major light directions of the light strips lean toward the bottom support. Specifically, the major light directions are directed to lower portion, instead of top portion, of the light bulb apparatus, i.e. more close to the bottom support instead of close to the top ends of the light strips.

To further enhance overall light pattern, the major light directions of the light strips also lean toward dark part of neighbor light strips. For example, the major direction of one light strip is directed to dark part, out of main light angle span area, of a neighbor light strip.

In some embodiments, there are more than one vertical bars for the central support. To increase the top polygonal shape of the light bulb apparatus, the top parts of these vertical bars are bent and connected to the top ends of the light strips.

BRIEF DESCRIPTION OF DRAWINGS

FIG. 10E illustrates the embodiment of FIG. 10A in another view angle.

DETAILED DESCRIPTION

Figure 1:
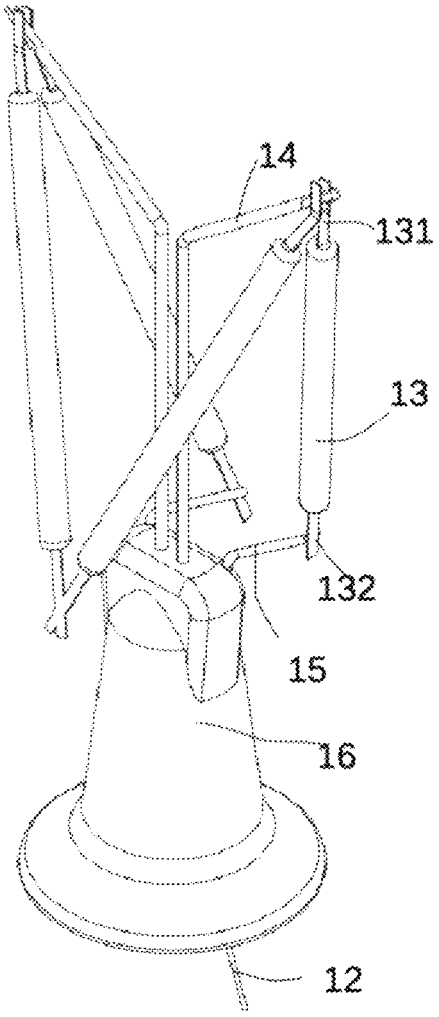
FIG. 1 illustrates major components of a light bulb embodiment.

According to an embodiment of the present invention, a light bulb apparatus has a head cup, a bottom support, multiple light strips and a bulb shell.

The head cup is designed to be connected to an external power source, e.g. complying with various Edison bulb cap standards. The head cup also has a containing space for storing a driver circuit for converting external power source to proper driving current to drive the LED components of the light apparatus.

The bottom support is connected and extended from the head cup. Parts of the bottom support are made of glass material. To provide better heat dissipation, heat dissipation air may be introduced into the bulb apparatus. In such case, the glass part of the bottom support may have a through hole to letting heat dissipation air into the bulb apparatus and then sealed during manufacturing.

The bottom support may be integrated with the bulb shell when they are both made of glass material. In addition to the glass part, there may be other material to form other parts of the bottom support.

The multiple light strips are mounted with LED modules. The LED modules may have different color temperatures and mixed to form a desired color temperature. In addition, the driver circuit may be configured to change luminous level of the LED modules, e.g. changing driving currents supplied to the LED modules.

In some embodiments, the LED modules have different types of LED modules with different color temperatures. The driver circuit may be configured to provide different driving current to different types of the LED modules so that when the LED are turned brighter, the mixed color temperature is more like a day light and when the LED are turned less brighter, the mixed color temperature is more like color temperature during sunset.

Each light strip has a top end and a bottom end. The bottom ends of the light strips are connected to the bottom support for being electrically connected to the driver circuit. In other words, the driver circuit provides driving current to the light strips via components of the bottom support, e.g. some metal bars or strips.

The top ends of the light strips form a top polygonal shape, and the bottom ends of the light strips form a bottom polygonal shape. The bottom polygonal shape has a bigger area size than the top polygonal shape. Since each light strip has a top end and a bottom end, the top polygonal shape may be geometrically similar, in some case, to the bottom polygonal shape. For example, the top polygonal shape and the bottom polygonal shape are both hexagonal shapes, just with different area sizes.

Each light strip has a skewed angle with respect to a middle axis perpendicular to the bottom polygonal shape. The middle axis is a virtual axis perpendicular to the bottom polygonal shape and extends from the middle of the bottom polygonal shape. The light strips surround the middle axis and are skewed with a skewed angle so that their projection are still not parallel to the middle axis.

The bulb shell is extended from the head cup covering the bottom support and the plurality of light strips.

In some embodiments, the bulb apparatus may further have a central support. The central support has a bottom part connected to the bottom support and having a top part connected to the top ends of the plurality of the light strips.

In some embodiments, the central support is a vertical bar that has its bottom part connected to the bottom support and its top part connecting to the top ends of the multiple light strips.

In some embodiments, the vertical bar has a metal top portion and an insulation middle portion. The insulation middle portion may be made of transparent plastic material or glass material to have a better appearance.

In some embodiments, the vertical bar has a metal part embedded in a glass portion of the bottom support. This may be implemented by placing the metal part in a molding device and then covered with fluid heated glass. After the glass is cooled, the metal part is sealed in the bottom support.

In some embodiments, the vertical bar is a tube. Such method reduces material usage and saves cost while keeping rigidity of the vertical bar.

In some embodiments, the vertical bar is an elongated folded metal sheet. In other words, an elongated sheet is folded to increase its rigidity.

In some embodiments, the vertical bar is metal material and has one more fins to help heat dissipation.

In some embodiments, the light bulb apparatus may further include a bracket for connecting the top ends of the light trips to the vertical bar.

The bracket may have multiple metal bars, or in other way, e.g. a circle shape with a bar connected to the vertical bar.

In some cases, the bracket has multiple metal bars and parts of the metal bars are welded to the vertical bar.

In some embodiments, the bracket may have multiple metal bars, parts of the metal bars are embedded to a glass portion of the vertical bar. Like what being explained above, when the vertical bar is made of glass material, parts of the bracket may be placed in a molding device and filled with fluid heated glass material. When the glass material is cooled down, the bracket is fixed to the vertical bar.

In some embodiments, the top end of the light strip has a metal portion extended from a substrate of the light strip. In such case, the light strip is made of a substrate mounted with LED modules that are further covered by fluorescent material. The substrate has a metal part and the metal part is extended to the top end of the light strip. In other words, the top end and the substrate of the light strip is one piece, which may be cut from a metal sheet.

The top ends of the light strips may be folded to keep the light strip with a distance from the vertical bar.

In some cases, two light strips are made together and form a pair. In such pair, the two light strips share the same metal material and thus their top ends are two portion of a one piece material. In such case, the connection between the two light strips has better electricity conductivity and may decrease unnecessary heat due to resistance of the connected portion between the two light strips.

Therefore, in a light bulb apparatus of such case, if there are six light strips, there are three pairs of light strips placed in the bulb apparatus, instead of fixing six independent light strips together, which may also decrease manufacturing time and difficulty.

In some embodiments, a connection part of the top ends of the two light strips surrounds the vertical bar. For example, the top ends of two light strips are welded together while leaving a hole in the middle of the connection. The vertical bar is placed in the middle of the connection, thus increasing robustness of overall light bulb structure.

In some embodiments, the top ends of the light strips are separately connected to a bracket and the bracket enables electrical connection between the two ends of the light strips. For example, the bracket may have multiple metal bars as mentioned above. The top ends of the light strips are separately welded to the metal bars. With the metal bar as an intermediate component, the light strips may be connected in desired connection manner, e.g. connected in series or in parallel.

Usually, the light strips have a major light emitting angle, e.g. 120 degrees. The central direction of the light emitting span is named as the major light direction.

In some embodiments, the major light directions of the light strips lean toward the bottom support. Specifically, the major light directions are directed to lower portion, instead of top portion, of the light bulb apparatus, i.e. more close to the bottom support instead of close to the top ends of the light strips.

To further enhance overall light pattern, the major light directions of the light strips also lean toward dark part of neighbor light strips. For example, the major direction of one light strip is directed to dark part, out of main light angle span area, of a neighbor light strip.

In some embodiments, there are more than one vertical bars for the central support. To increase the top polygonal shape of the light bulb apparatus, the top parts of these vertical bars are bent and connected to the top ends of the light strips.

FIG. 1 illustrates major components of a light bulb embodiment.

The above LED module may be embedded into a bulb with Edison bulb head to be mounted on standard Edison bulb socket. The LED module includes a bottom support 16, with conductive wires 12 inside to connect to power supply. Two or more LED strips 13 are mounted on a central support 14. Each LED bar 13 has a substrate plate extending two leads 131 as top end, 132 as bottom end which are connected to the central support 14 and the conductive wire 15, respectively. In this example, the LED strips 13 are connected in series, and the central support is not directly connecting to any power supply. The central support may be made of metal materials. Transparent materials may also be used under different design requirements.

A transparent or translucent bulb cover made of glass or other material may be used for enclosing the LED module. While a translucent, not 100% transparent cover, is used, the arrangement of the LED bars may form visible dark/light strips on its surface.

Figure 2:
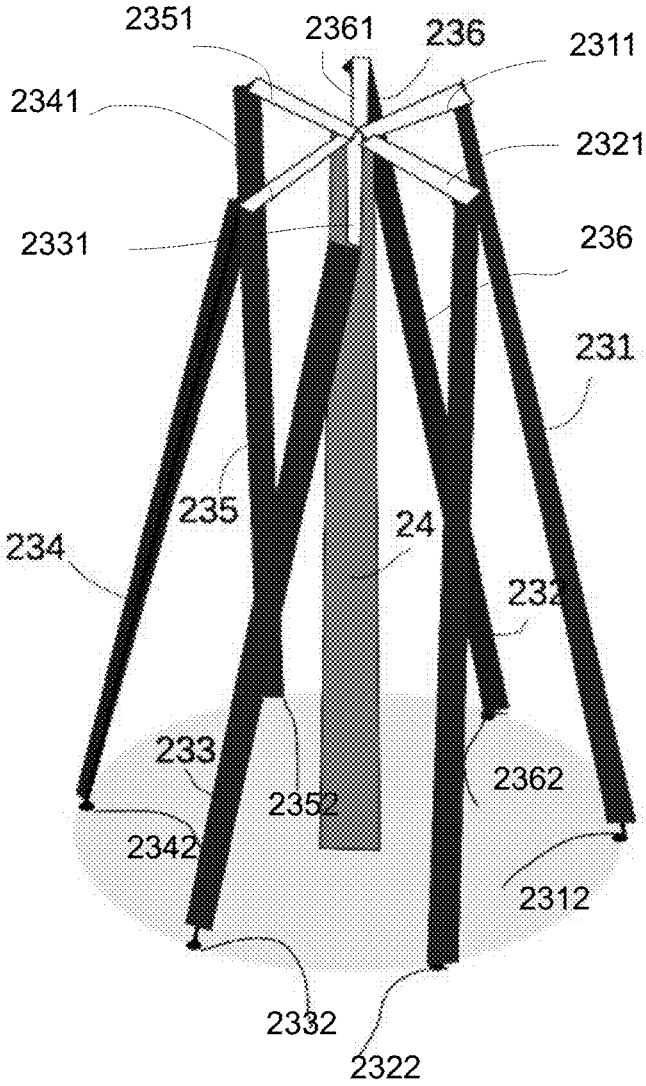
FIG. 2 illustrates how the light strips are skewed.

FIG. 2 illustrates how the light strips are skewed.

In this example, three pairs of LED strips 231, 232, 233, 234, 235, 236 are connected to a central support 24. Each LED bar 231, 232, 233, 234, 235, 236 is rotated with an angle so that they are not standing vertically with respect to the central support 24. In addition, each LED bar 231, 232, 233, 234, 235, 236 has its major illuminant angle facing downwardly and pointing to a neighbor LED bar so that the shadow or bright part projected onto a translucent bulb cover may be eliminated. The central support may be made of metal or glass or other materials.

In this example, the top ends 2311, 2321, 2331, 2341, 2351, 2361 of the light strips 231, 232, 233, 234, 235, 236 form a top polygonal shape, and the bottom ends 2312, 2322, 2332, 2342, 2352, 2362 form a bottom polygonal shape.

The top polygonal shape and the bottom polygonal shape are similar but has a shifted angled, or say a skewed angle between them.

Figure 3A:
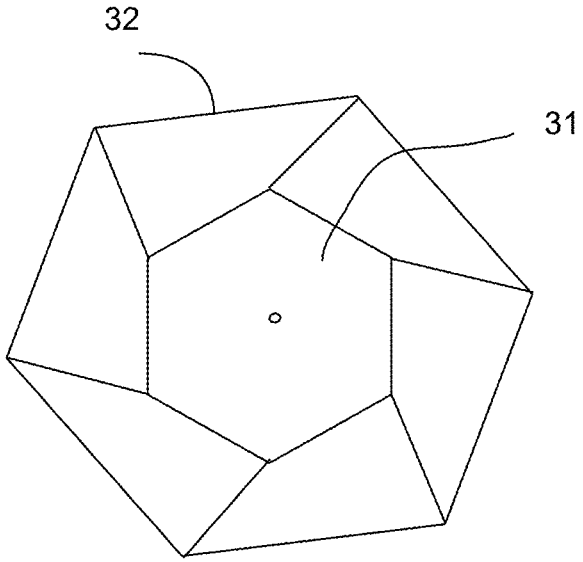
FIG. 3A illustrates the relation between the top polygonal shape and the bottom polygonal shape in an embodiment.

FIG. 3A illustrates the relation between the top polygonal shape and the bottom polygonal shape in an embodiment.

Figure 3B:
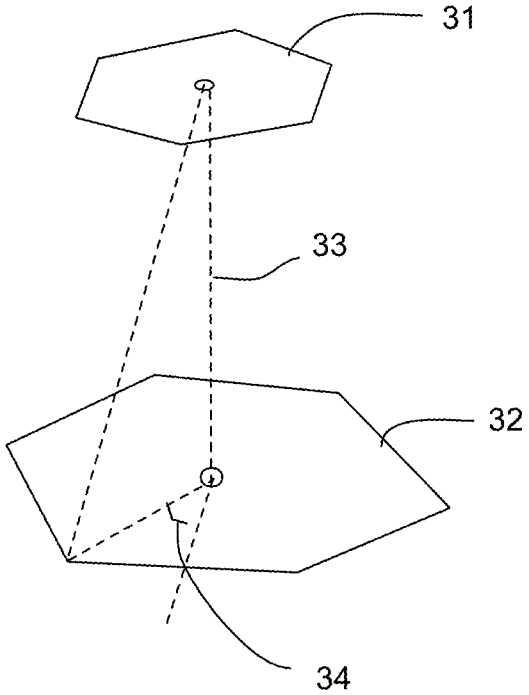
FIG. 3B illustrates a perspective view of FIG. 3A.

FIG. 3B illustrates a perspective view of FIG. 3A.

In FIG. 3A, from a top view, it is illustrated that the top polygonal shape 31 is similar to the bottom polygonal shape 32, and there is a skewed angle between the top polygonal shape 31 and the bottom polygonal shape 32.

In FIG. 3B, from a perspective view, the middle points of the top polygonal shape 31 and the bottom polygonal shape 32 form a virtual middle axis 33. There are various ways to define the skew angle of each light strip. In this case, the skew angle of each light strip with respect to the middle axis may be referred to an equivalent measure, i.e. the angle 34.

Figure 4:
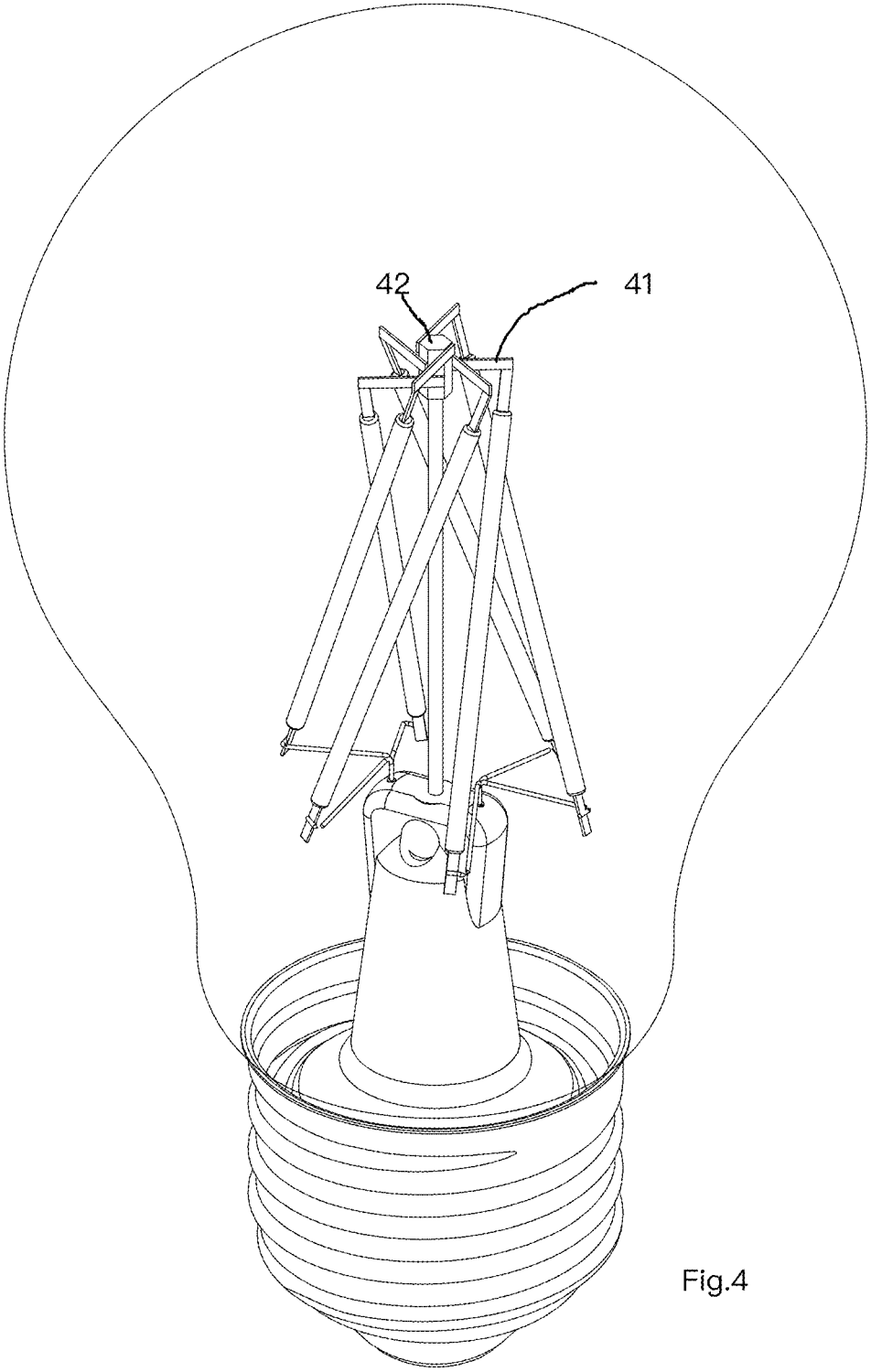
FIG. 4 illustrates an embodiment of a light bulb apparatus.

FIG. 4 illustrates an embodiment of a light bulb apparatus.

In this example, the top ends 41 have a folded portion connected to the central support 42.

Figure 5:
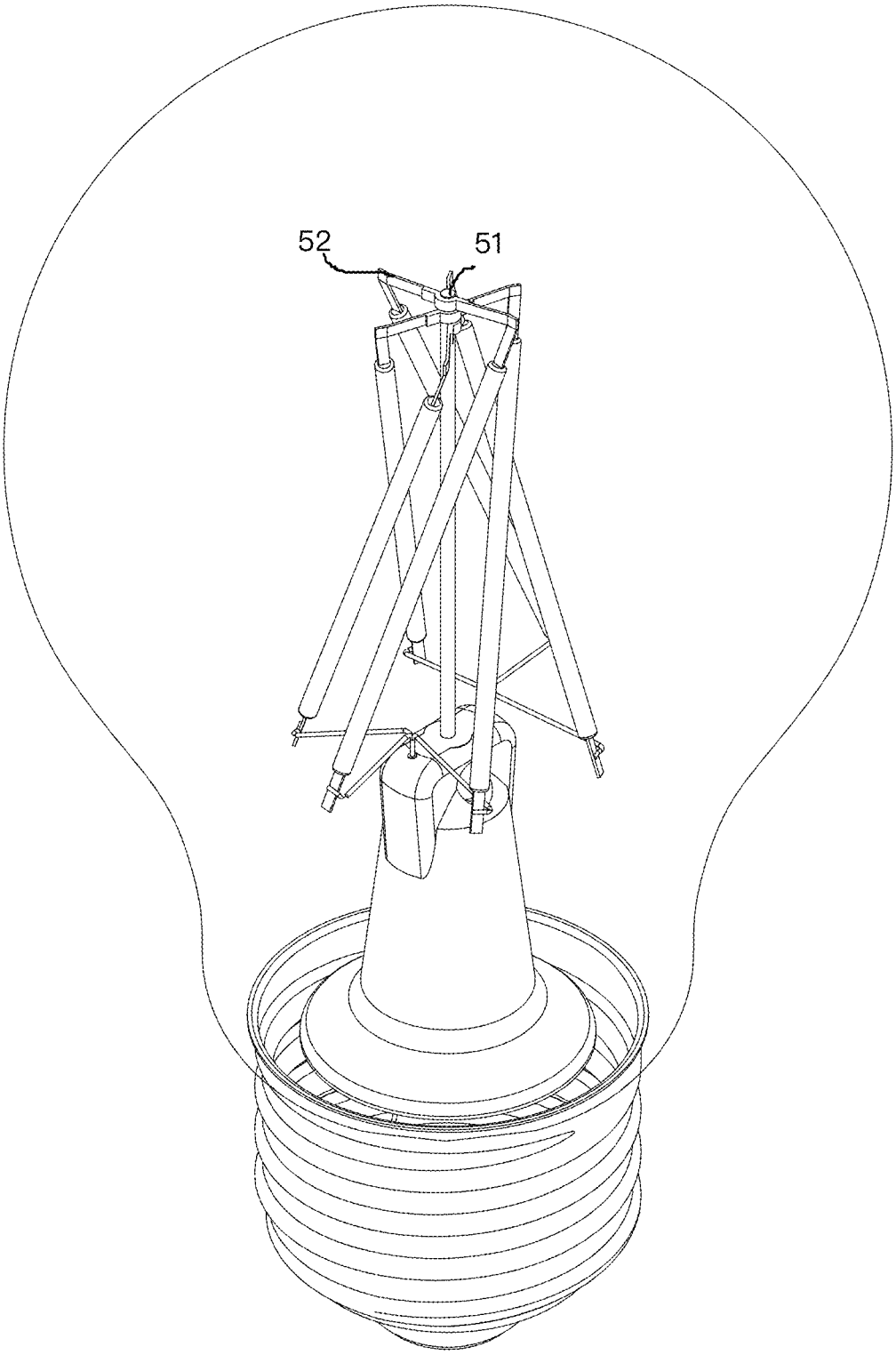
FIG. 5 illustrates another embodiment of a light bulb apparatus.

FIG. 5 illustrates another embodiment of a light bulb apparatus.

In this example, unlike FIG. 4, the connection of top ends of two light strips 52 surrounds the central support 51.

Figure 6:
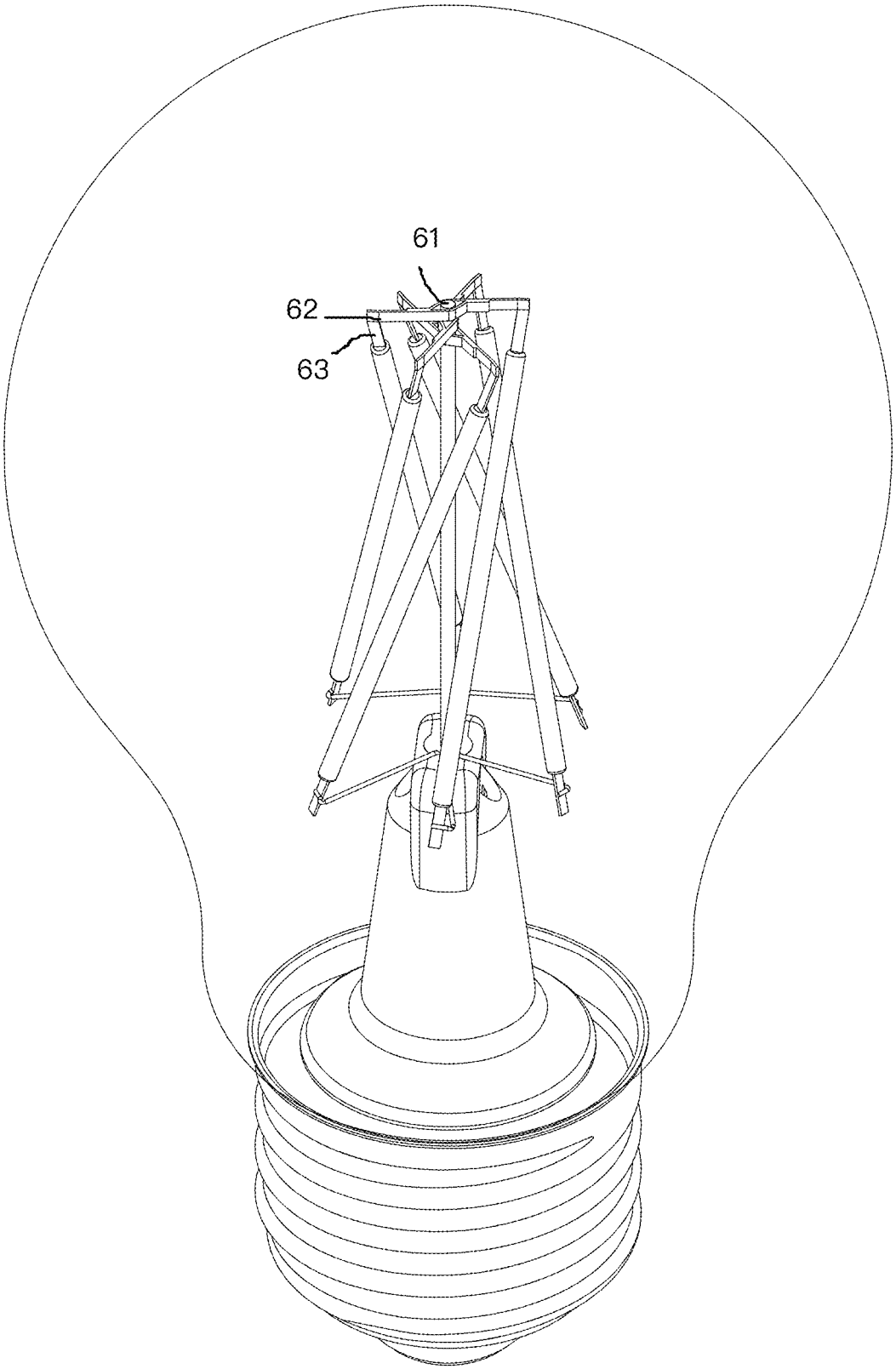
FIG. 6 illustrates another embodiment of a light bulb apparatus.

FIG. 6 illustrates another embodiment of a light bulb apparatus.

In this example, there is a bracket 62 connected to the central support 61, and the top end 63 of a light strip is connected to the central support 61 via the bracket 62.

Figure 7A:
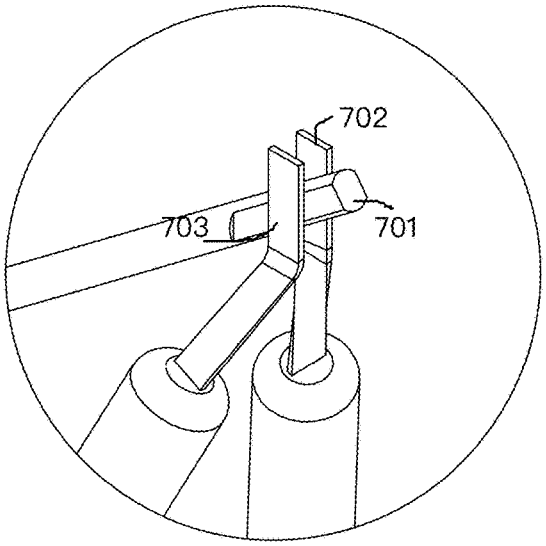
FIG. 7A illustrates a connection manner at top ends of light strips in an embodiment.

FIG. 7A illustrates a connection manner at top ends of light strips in an embodiment.

In this example, a bracket 701 is extended from the central support, and top ends 702, 703 are welded to two sides of the bracket 701.

Figure 7B:
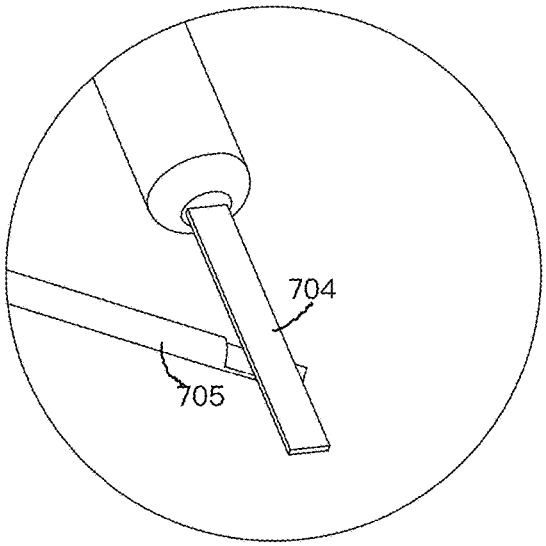
FIG. 7B illustrates another connection manner at top ends of light strips in an embodiment.

FIG. 7B illustrates another connection manner at top ends of light strips in an embodiment.

In this example, a bottom end 704 is welded to a metal bar 705 of the bottom support.

Figure 7C:
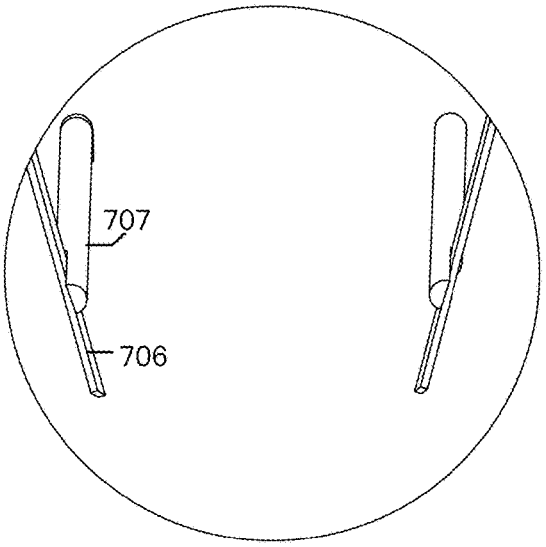
FIG. 7C illustrates another connection manner at top ends of light strips in an embodiment.

FIG. 7C illustrates another connection manner at top ends of light strips in an embodiment.

In this example, there is a flatten surface between a top end 706 and a bracket 707.

Figure 7D:
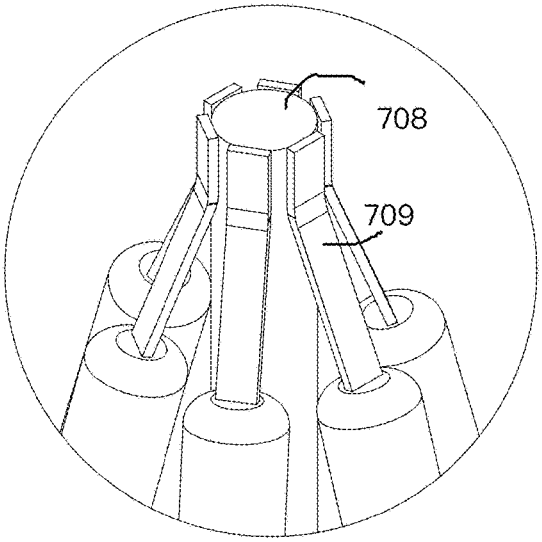
FIG. 7D illustrates another connection manner at top ends of light strips in an embodiment.

FIG. 7D illustrates another connection manner at top ends of light strips in an embodiment.

In this example, the top end 709 is bent and connected to the central support 708.

Figure 7E:
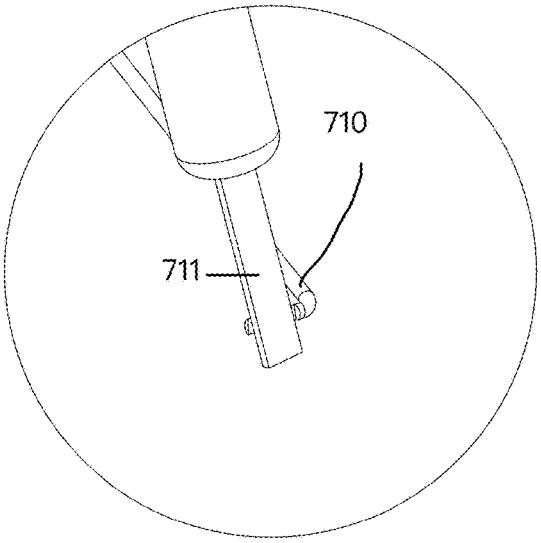
FIG. 7E illustrates another connection manner at top ends of light strips in an embodiment.

FIG. 7E illustrates another connection manner at top ends of light strips in an embodiment.

In this example, there is a bent portion in the bracket 710 for connecting to the top end 711 of a light strip.

Figure 7F:
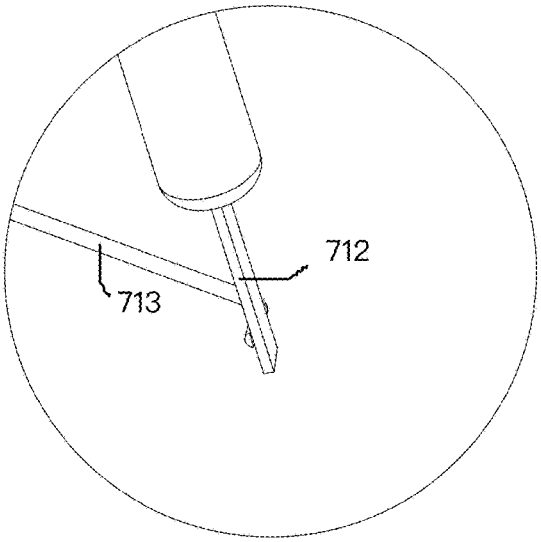
FIG. 7F illustrates another connection manner at top ends of light strips in an embodiment.

FIG. 7F illustrates another connection manner at top ends of light strips in an embodiment.

In this example, as another view angle of FIG. 7E, there is a bent portion in the bracket 713 for connecting to the top end 712 of a light strip.

Figure 7G:
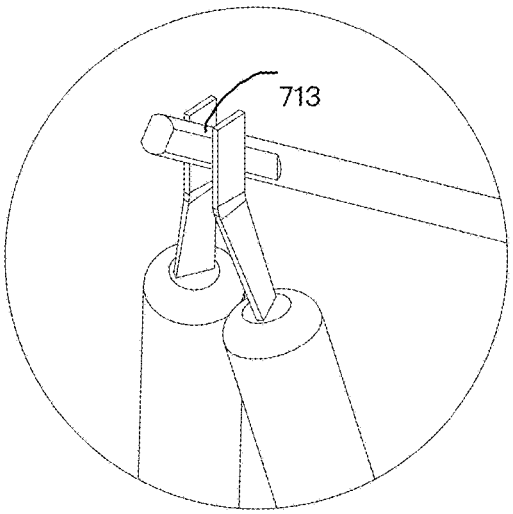
FIG. 7G illustrates another connection manner at top ends of light strips in an embodiment.

FIG. 7G illustrates another connection manner at top ends of light strips in an embodiment.

In FIG. 7G, it illustrates that there are flatten surface in the connection portion 713 of a bracket for connecting two strips in its two sides.

Figure 7I:
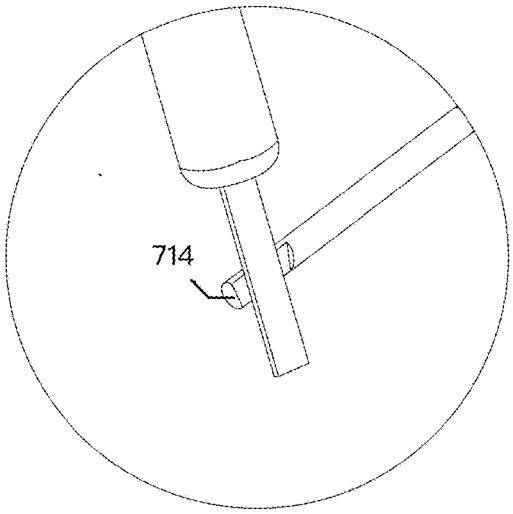
FIG. 7I illustrates another connection manner at top ends of light strips in an embodiment.

FIG. 7I illustrates another connection manner at top ends of light strips in an embodiment.

In this example, it illustrates a flatten surface exists in a metal wire 714 of a bottom support.

Figure 7J:
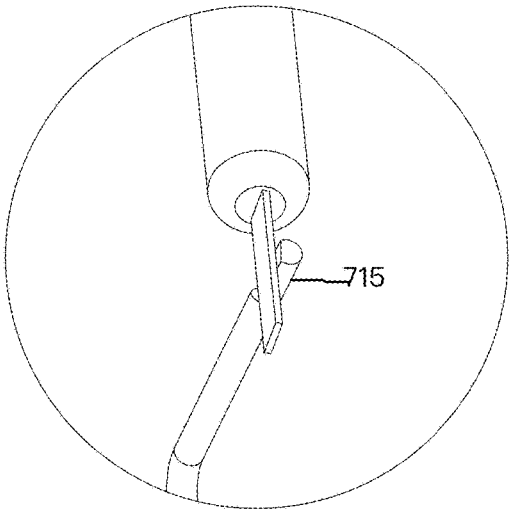
FIG. 7H illustrates another connection manner at top ends of light strips in an embodiment.
FIG. 7K illustrates another connection manner at top ends of light strips in an embodiment.
FIG. 7L illustrates another connection manner at top ends of light strips in an embodiment.

FIG. 7J illustrates another connection manner at top ends of light strips in an embodiment.

In this example, it illustrates a flatten surface in the connection portion of a bracket 715 corresponding to a flat surface of a top end of a light strip.

Figure 7K:
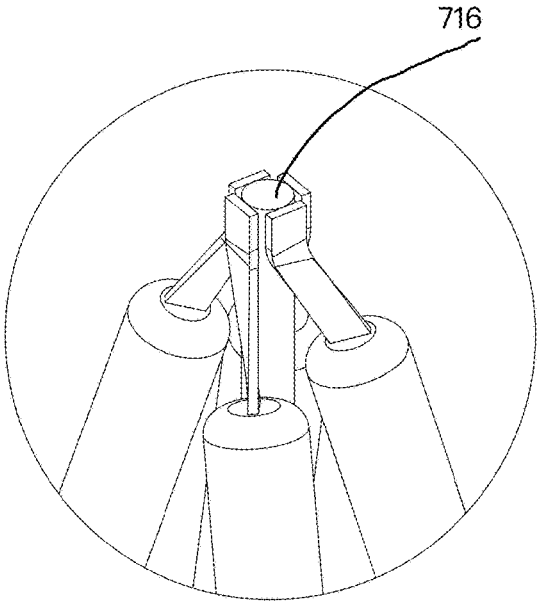

FIG. 7K illustrates another connection manner at top ends of light strips in an embodiment.

In this example, the central support 716 is surrounded by four light strips.

Figure 7L:
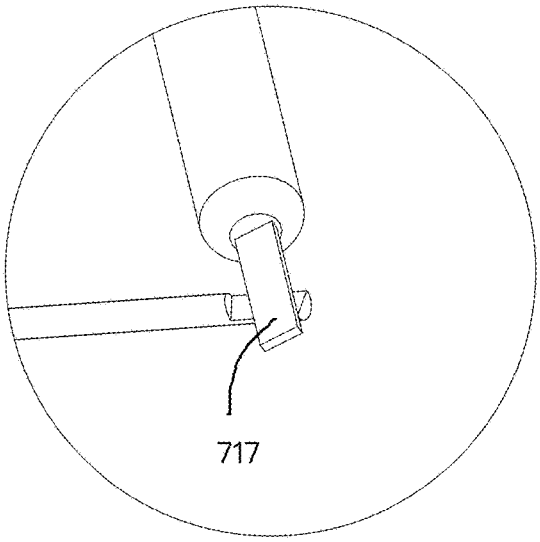

FIG. 7L illustrates another connection manner at top ends of light strips in an embodiment.

In this example, the bottom end 717 of a light strip is connected to a straight metal wire of a bottom support.

Figure 7H:
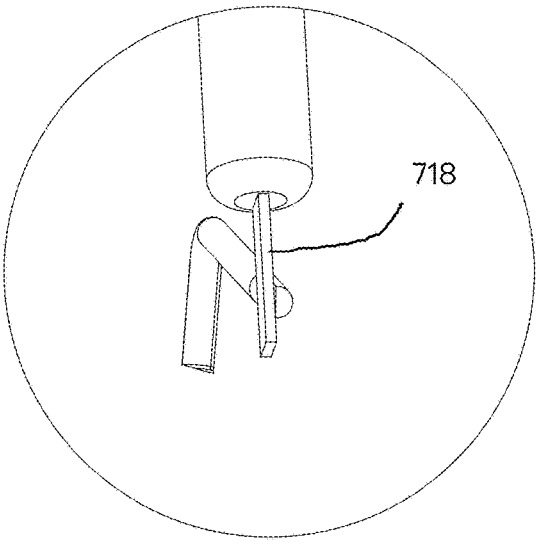

FIG. 7H illustrates another connection manner at top ends of light strips in an embodiment.

In this example, unlike FIG. 7L, there is a bent portion in the bracket to connect to the top end 718 of a light strip.

Figure 8A:
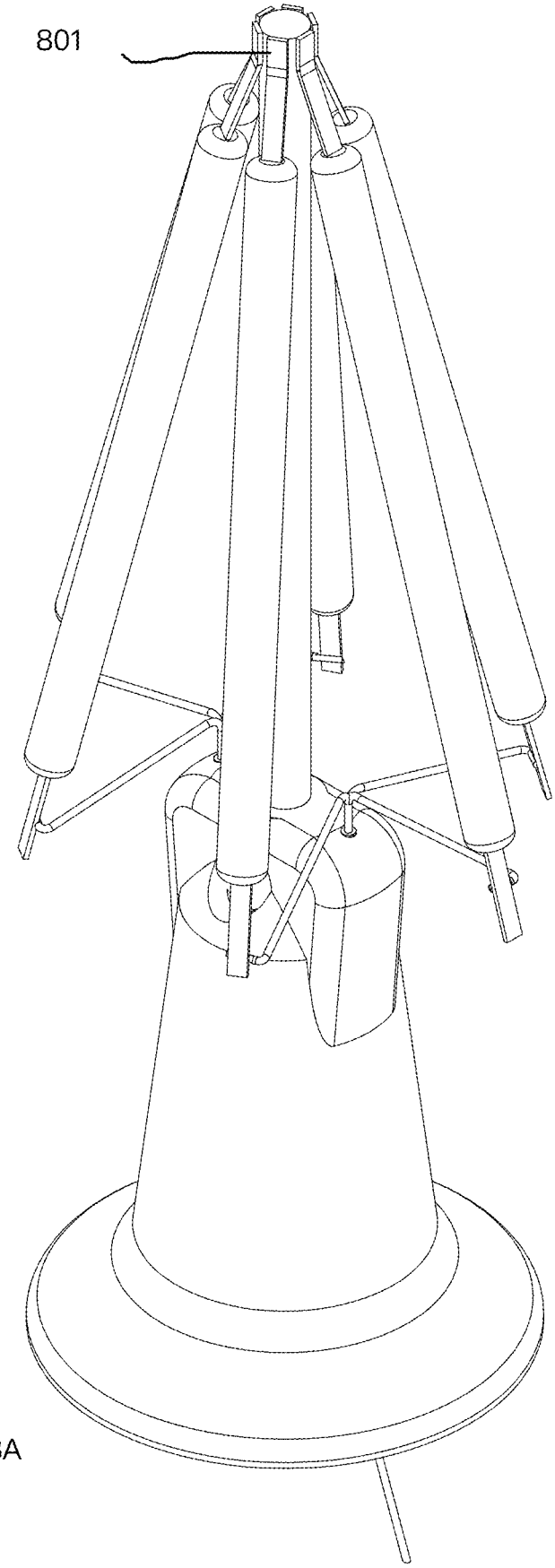
FIG. 8A illustrates another embodiment.
Figure 8B:
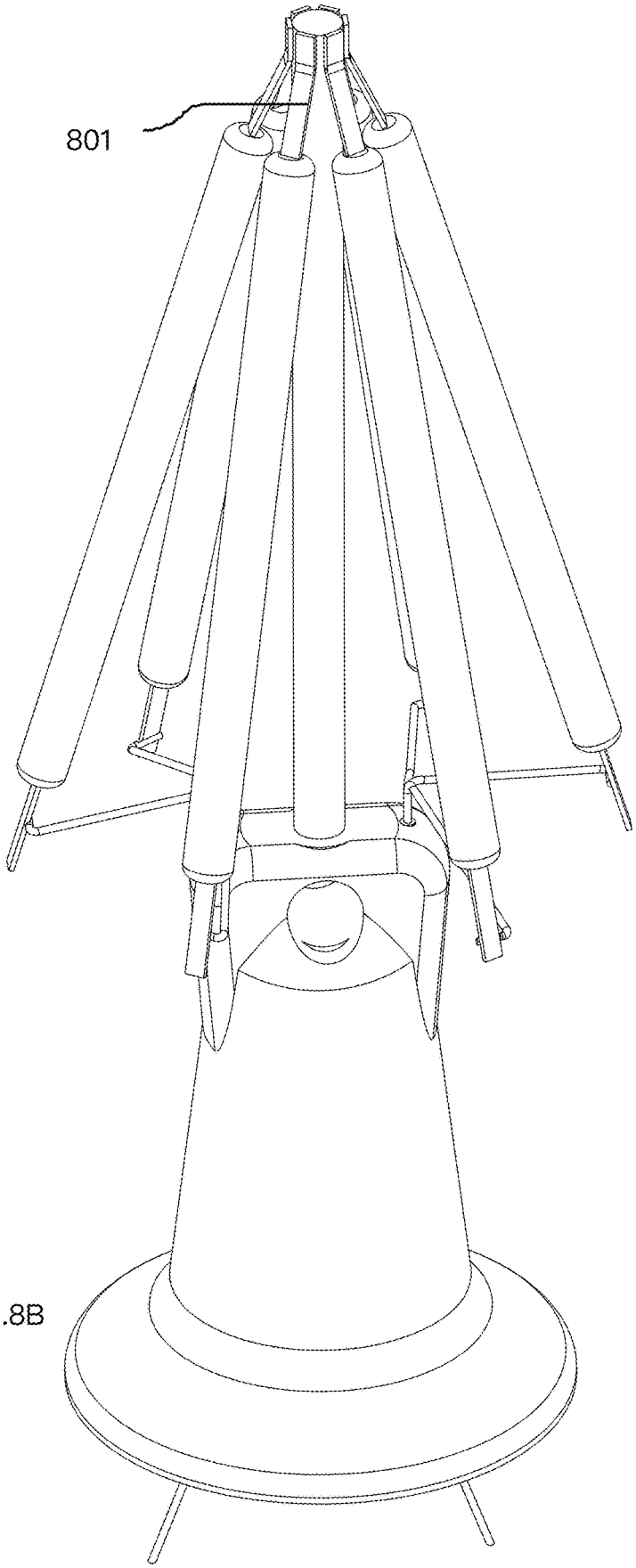
FIG. 8B illustrates the embodiment of FIG. 8A in another view angle.

FIG. 8A illustrates another embodiment. FIG. 8B illustrates the embodiment of FIG. 8A in another view angle.

Figure 8C:
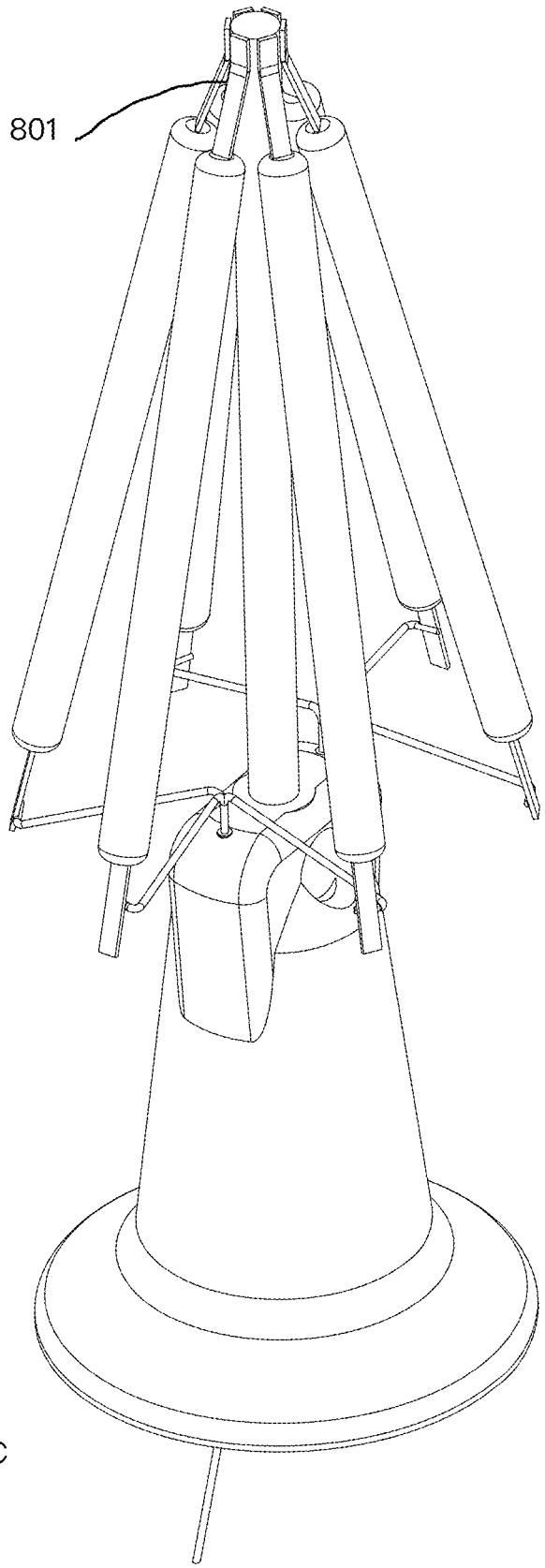
FIG. 8C illustrates the embodiment of FIG. 8A in another view angle.

In FIG. 8A, FIG. 8B and FIG. 8C, the central support 801 is surrounded by six light strips. In this example, there is no skewed angle for the light strip.

Figure 9A:
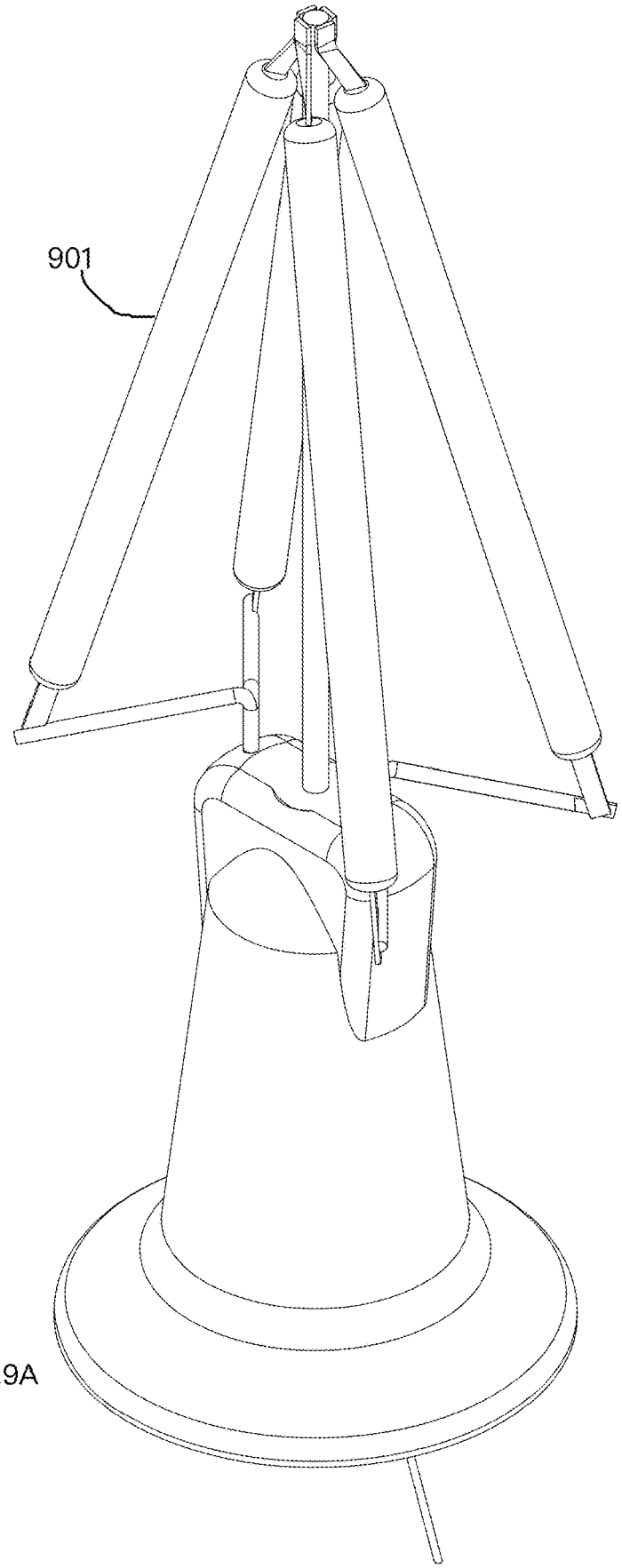
FIG. 9A illustrates another embodiment.
Figure 9B:
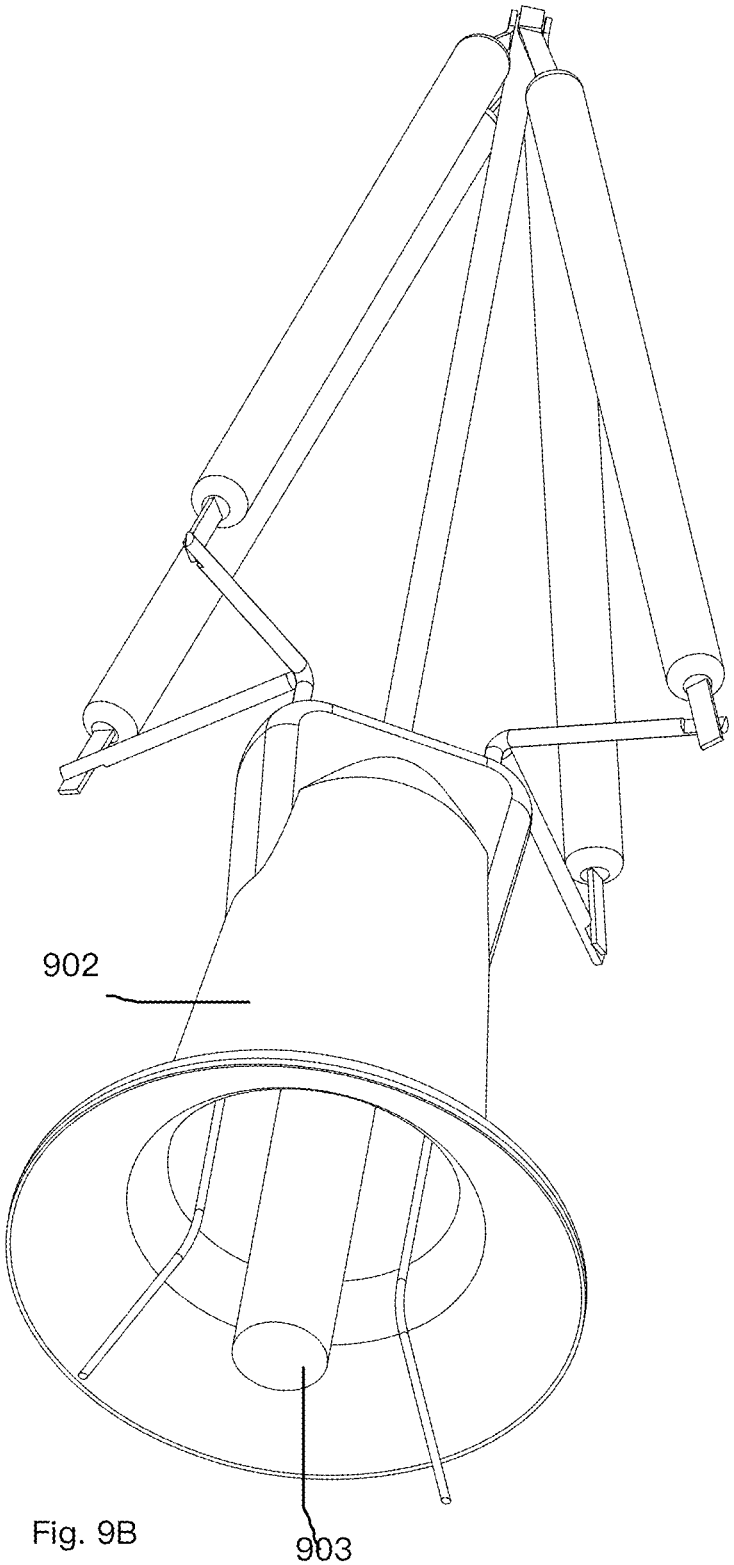
FIG. 9B illustrates the embodiment of FIG. 9A in another view angle.
Figure 9C:
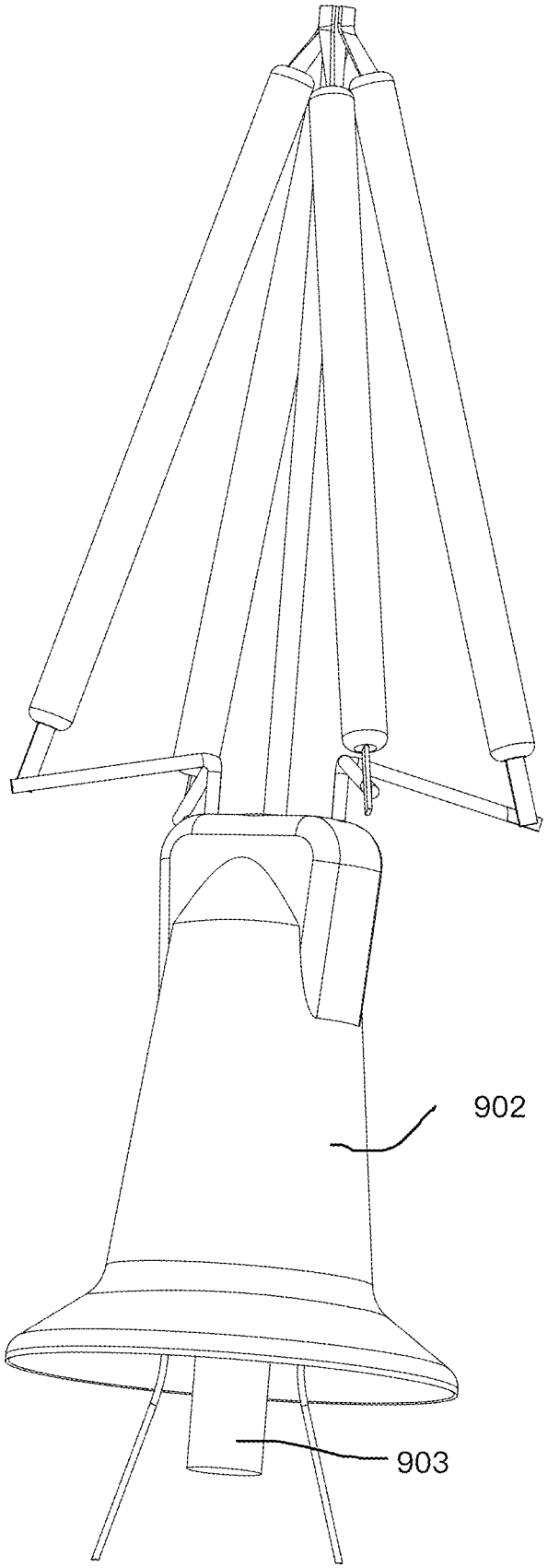
FIG. 9C illustrates the embodiment of FIG. 9A in another view angle.

FIG. 9A illustrates another embodiment. FIG. 9B illustrates the embodiment of FIG. 9A in another view angle. FIG. 9C illustrates the embodiment of FIG. 9A in another view angle.

In FIG. 9A, FIG. 9B and FIG. 9C, there are four light strips 901, with their bottom ends being supported with a larger area by metal wires of a bottom support 902. The central support has an air injection portion 903, which allows heat dissipation air to enter the bulb and is closed by heating the bottom portion 903 after air is filled.

Figure 10A:
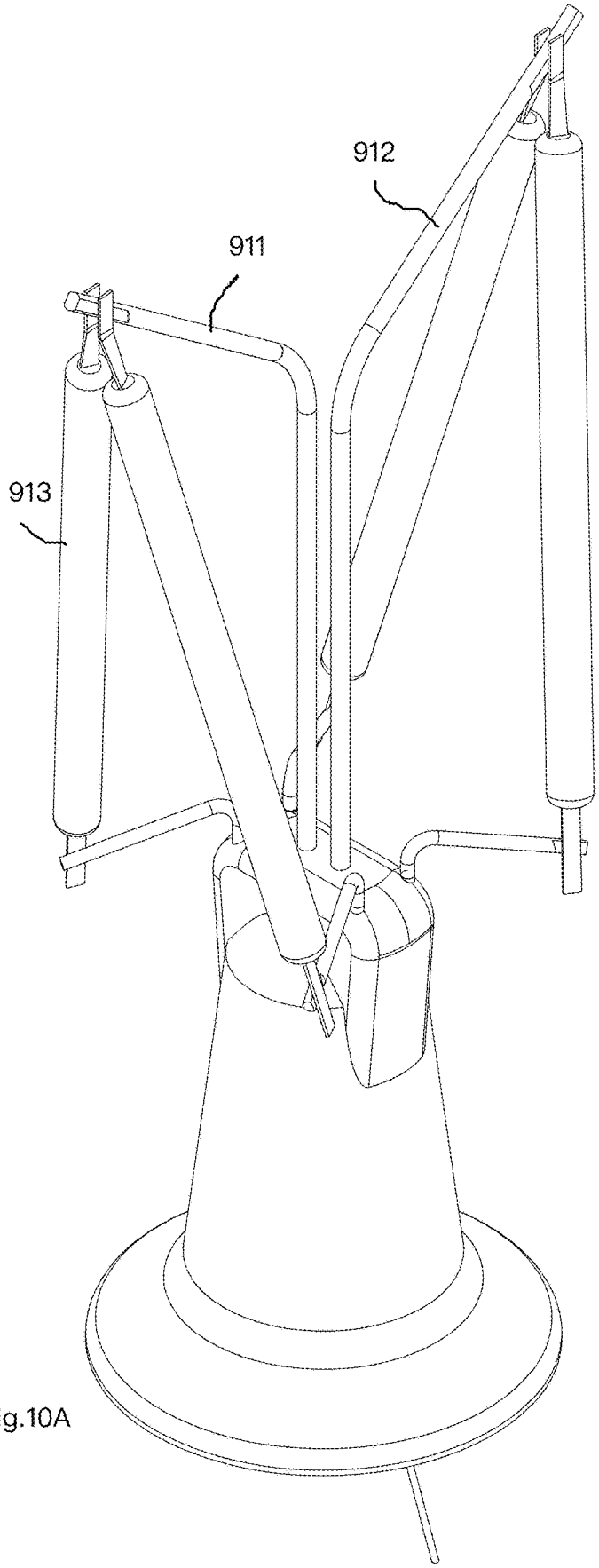
FIG. 10A illustrates another embodiment.
Figure 10B:
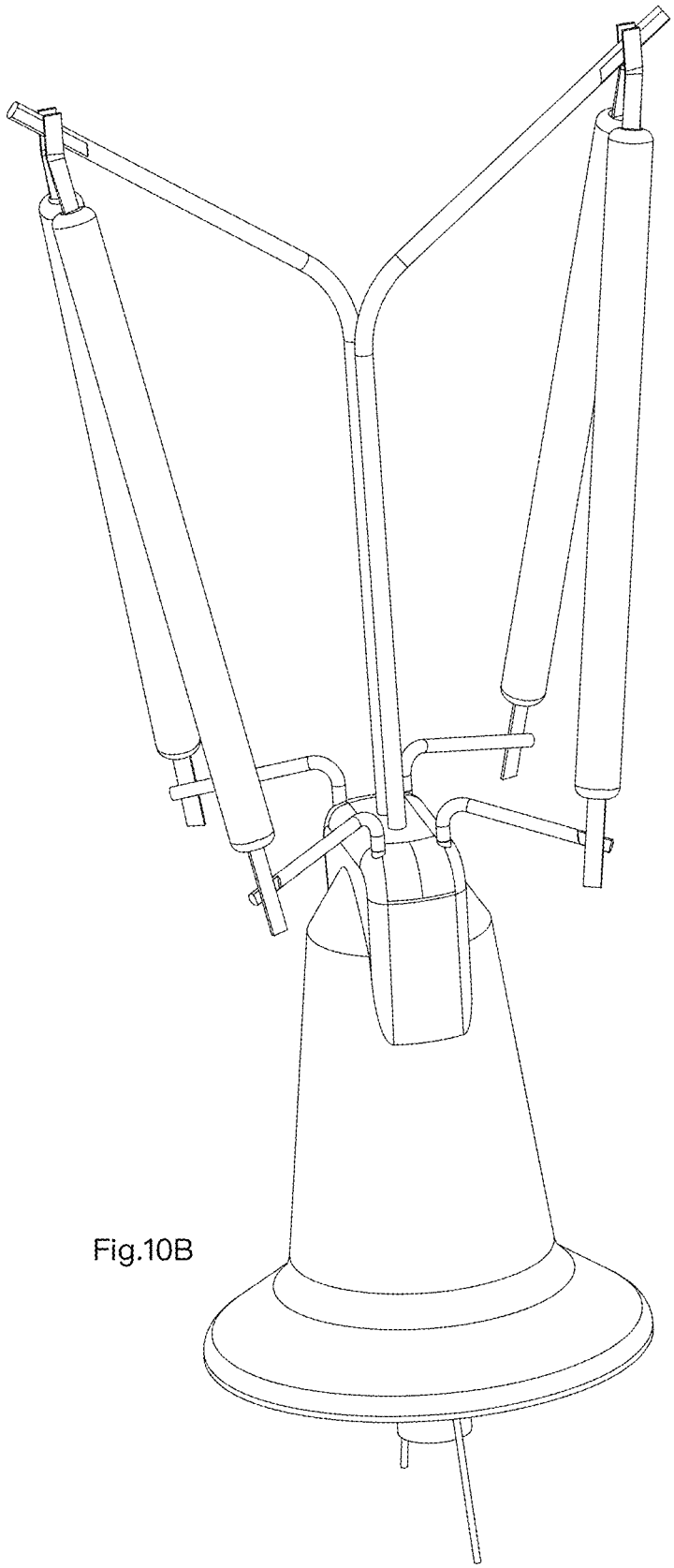
FIG. 10B illustrates the embodiment of FIG. 10A in another view angle.
Figure 10C:
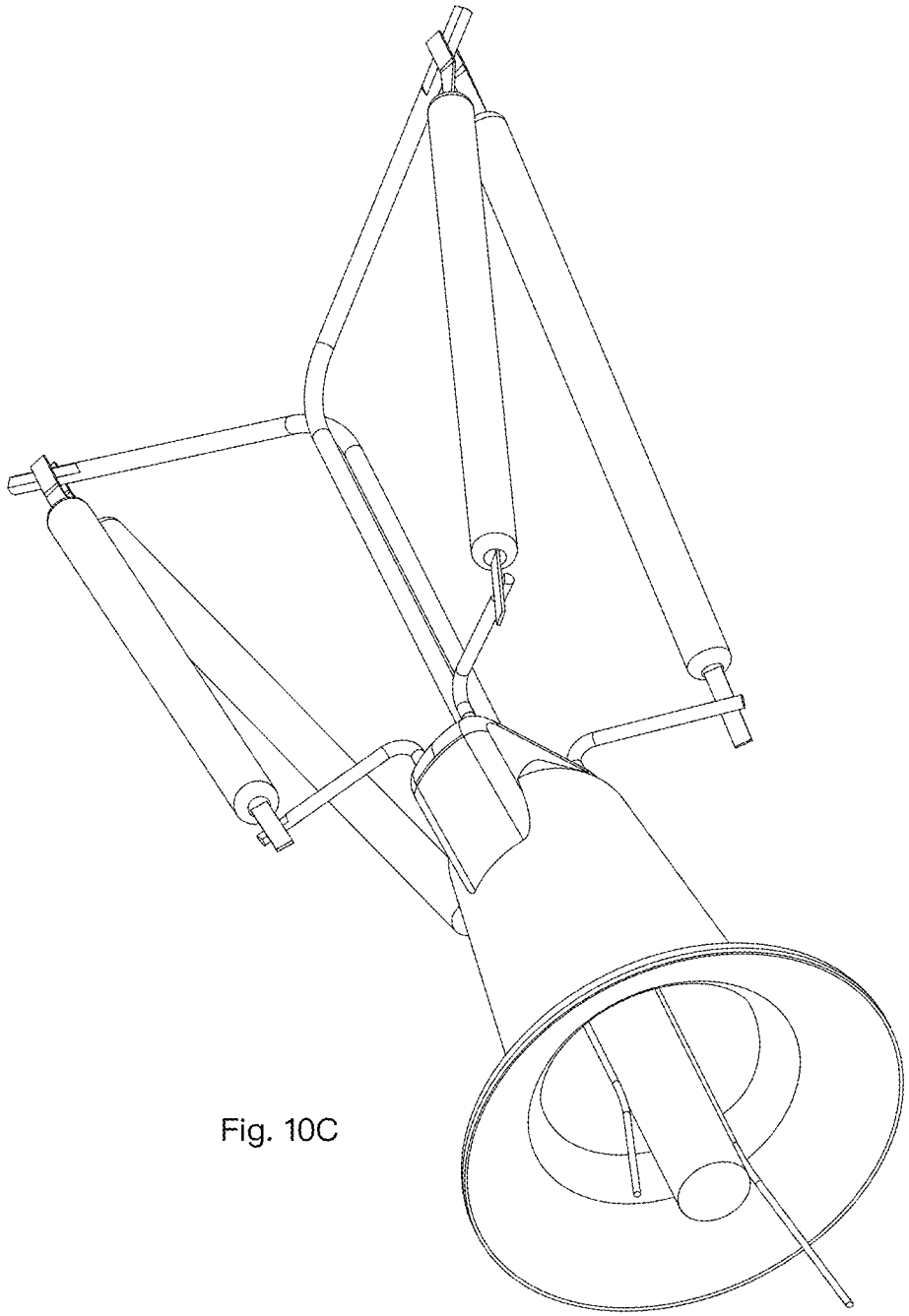
FIG. 10C illustrates the embodiment of FIG. 10A in another view angle.
Figure 10D:
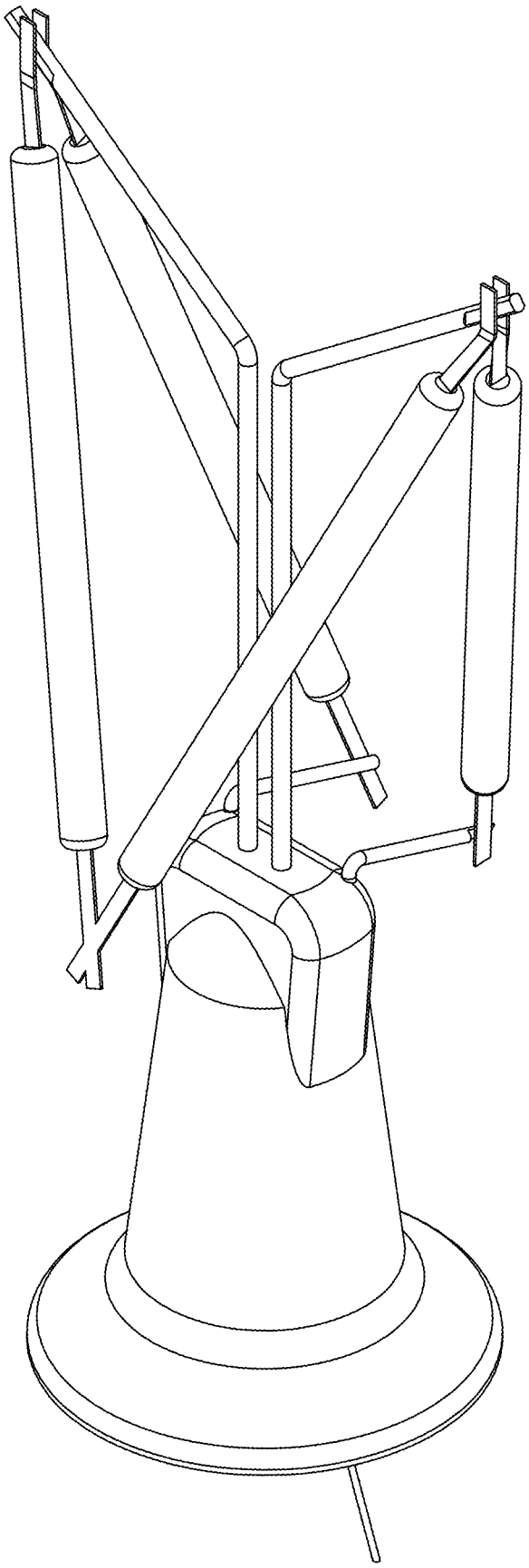
FIG. 10D illustrates the embodiment of FIG. 10A in another view angle.
Figure 10F:
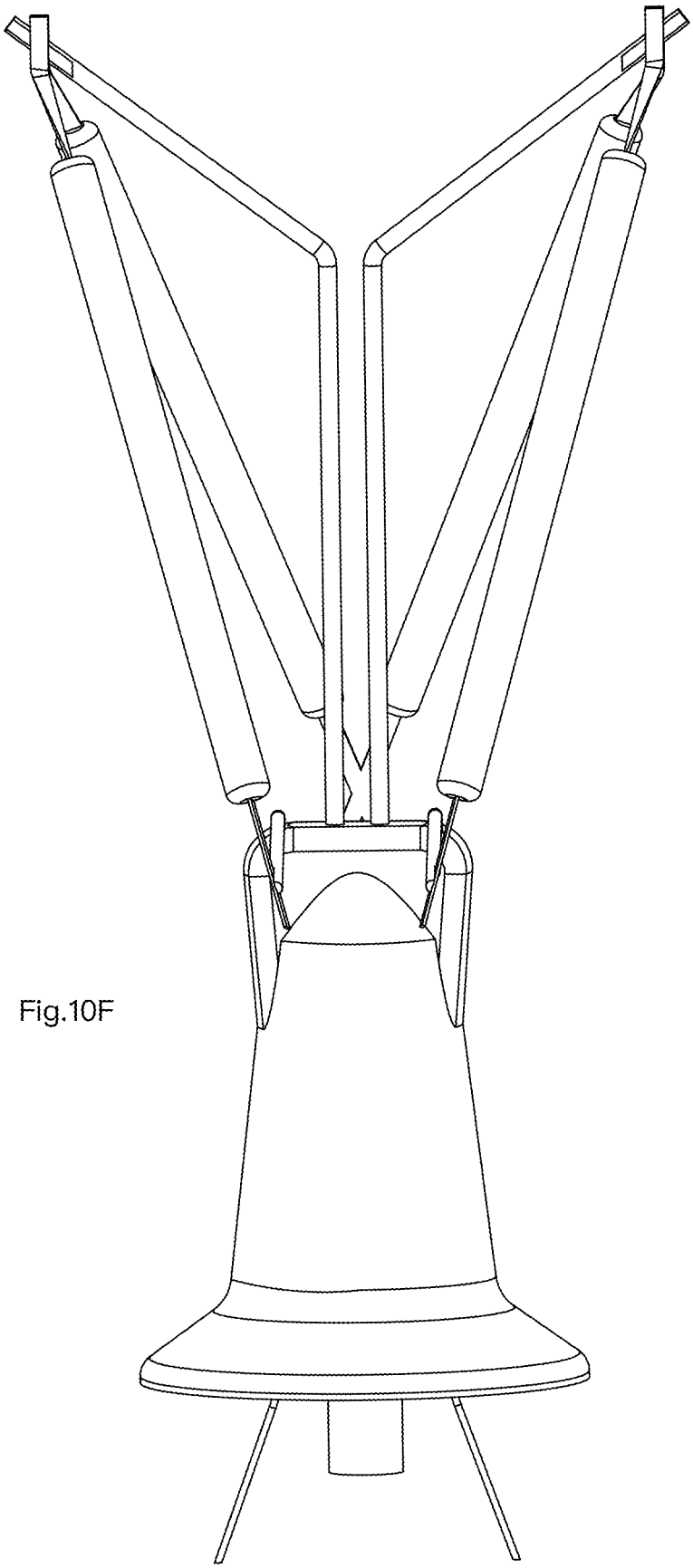
FIG. 10F illustrates the embodiment of FIG. 10A in another view angle.

FIG. 10A illustrates another embodiment. FIG. 10B illustrates the embodiment of FIG. 10A in another view angle. FIG. 10C illustrates the embodiment of FIG. 10A in another view angle. FIG. 10C illustrates the embodiment of FIG. 10A in another view angle. FIG. 10E illustrates the embodiment of FIG. 10A in another view angle. FIG. 10F illustrates the embodiment of FIG. 10A in another view angle.

In this example, there are two vertical bars with their top portions 911, 912 bent to get a larger area to expand the light strip 913.

Figure 11:
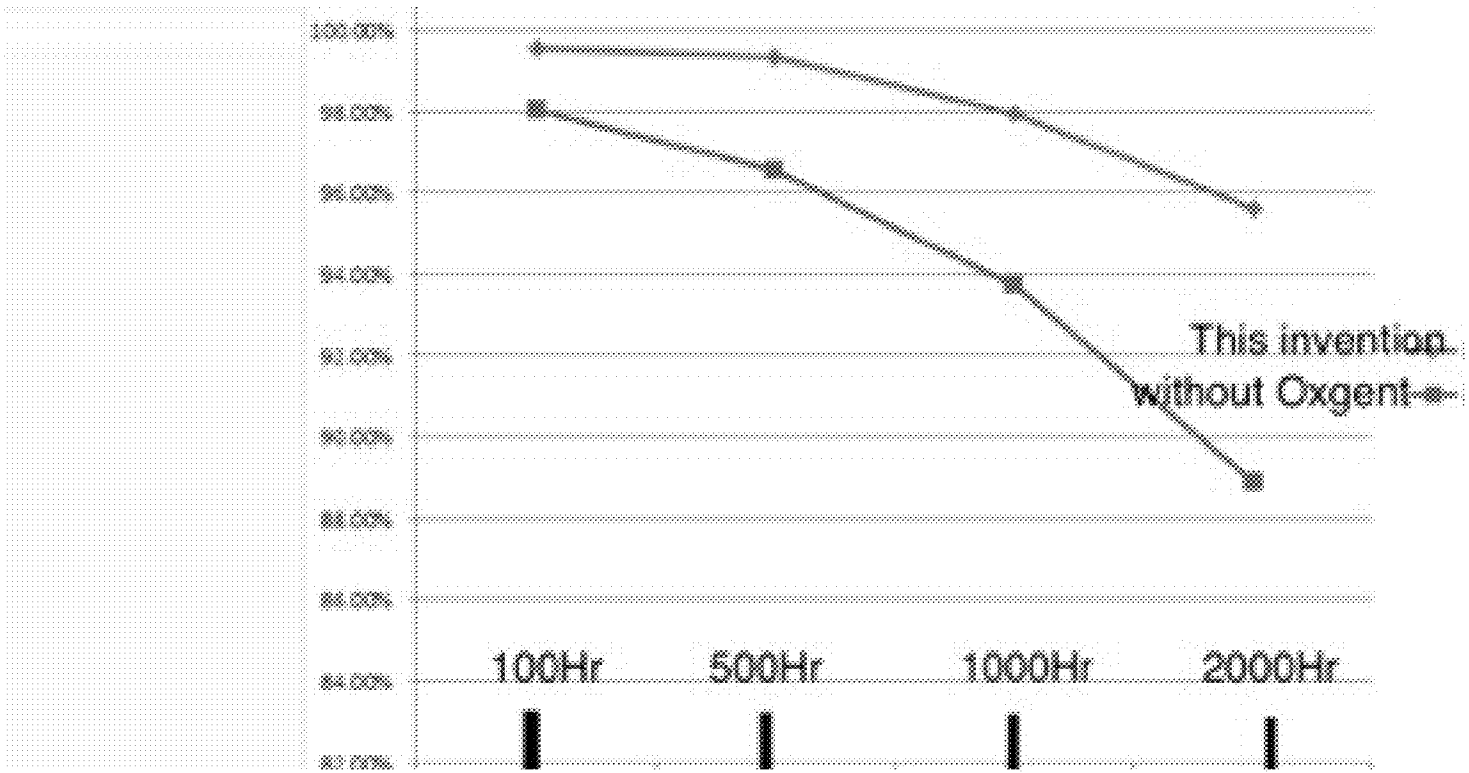
FIG. 11 is an experiment result showing effect with protection gas.

FIG. 11 is an experiment result showing effect with protection gas.

Under experiments, it is found that adding 1% oxygen (O2) together with 90% He provides unexpected effect to keep the LED strips of the filament module 2 more stable during long time experiment. The LED strips are covered with fluorescent layers above LED chips. With certain amount of added oxygen mixed with other inert gas like He as a protection gas, there is certain surface reaction on the fluorescent layer, which form a protection layer to protect the LED strips, making the LED strips more stable with longer life span.

Preferably, it is also found that keeping 3% to 10%, or even 4% to 6% of Oxygen to be mixed with other gas to be filled into the enclosing space would bring even better effect.

During manufacturing, there is a channel reserved in the stem 3. The gas with 1% or more oxygen is filled into the enclosing space via the channel. After the gas is filled in, the channel is sealed to close the enclosing space to keep the filled gas staying in the enclosing space.

FIG. 11 illustrates an experiment showing that with the protection gas of He and Oxygen, the life span of a light bulb is extended.

In some experiments, the protection gas may be preferably containing 20% oxygen and 80% He. In some embodiments, in addition to He, the oxygen is more than 20% of the protection gas. In some embodiments, in addition to He, the oxygen is more than 5% of the protection gas, and in some other experiments, the oxygen is more than 5% of the protection gas.

In addition to the above-described embodiments, various modifications may be made, and as long as it is within the spirit of the same invention, the various designs that can be made by those skilled in the art are belong to the scope of the present invention.

The invention claimed is:

1. A light bulb apparatus, comprising:

a head cup for storing a driver circuit and for connecting to an external power source;

a bottom support extended from the head cup;

a plurality of light strips mounted with LED modules, each light strip having a top end and a bottom end, the bottom ends of the light strips connecting to the bottom support for being electrically connected to the driver circuit, the top ends of the light strips forming a top polygonal shape, the bottom ends of the light strips forming a bottom polygonal shape, the bottom polygonal shape is similar to the top polygonal shape, each light strip having a skewed angle with respect to a middle axis perpendicular to the bottom polygonal shape; and a bulb shell extended from the head cup covering the bottom support and the plurality of light strips and the bulb shell forming a container filled with a protection gas with more than 1% of oxygen.

2. The light bulb apparatus of claim 1, further comprising a central support having a bottom part connected to the bottom support and having a top part connected to the top ends of the plurality of the light strips.

3. The light bulb apparatus of claim 2, wherein the central support comprises a vertical bar.

4. The light bulb apparatus of claim 3, wherein the vertical bar has a metal top portion and an insulation middle portion.

5. The light bulb apparatus of claim 3, wherein the vertical bar has a metal part embedded in a glass portion of the bottom support.

6. The light bulb apparatus of claim 3, wherein the vertical bar is a tube.

7. The light bulb apparatus of claim 3, wherein the vertical bar is an elongated folded metal sheet.

8. The light bulb apparatus of claim 3, further comprising a bracket for connecting the top ends of the light trips to the vertical bar.

9. The light bulb apparatus of claim 8, wherein the bracket comprises multiple metal bars, parts of the metal bars are welded to the vertical bar.

10. The light bulb apparatus of claim 8, wherein the bracket comprises multiple metal bars, parts of the metal bars are embedded to a glass portion of the vertical bar.

11. The light bulb apparatus of claim 3, wherein the top end of the light strip has a metal portion extended from a substrate of the light strip.

12. The light bulb apparatus of claim 11, wherein the metal portion of the top end of the light strip is folded and connected to the vertical bar.

13. The light bulb apparatus of claim 11, wherein the protection gas, in addition to He, comprising more than 5% Oxygen.

14. The light bulb apparatus of claim 1, wherein the protection gas, in addition to He, comprising more than 20% Oxygen.

15. The light bulb apparatus of claim 11, wherein the protection gas, in addition to He, comprising more than 10% Oxygen.

16. The light bulb apparatus of claim 1, wherein 3% to 10% of the protection gas is Oxygen.

17. The light bulb apparatus of claim 16, wherein 4% to 6% of the protection gas is Oxygen.

18. The light bulb apparatus of claim 17, wherein the major light directions of the light strips also lean toward dark part of neighbor light strips.

19. The light bulb apparatus of claim 1, wherein the protection gas comprises He.

20. The light bulb apparatus of claim 19, wherein 90% of the protection gas is He.

* * * * *